United States Patent [19]

Waldron et al.

[11] 4,258,920

[45] Mar. 31, 1981

[54] MAGNETIC JIGSAW PUZZLE

[76] Inventors: Don C. Waldron; Phanoy Waldron, both of Rt. 4, Box 985, Port Angeles, Wash. 98362

[21] Appl. No.: 929,218

[22] Filed: Jul. 31, 1978

[51] Int. Cl.[3] ..... A63F 9/10

[52] U.S. Cl. ..... 273/157 R; 162/160

[58] Field of Search ..... 273/157 R, 239; 162/138, 160

[56] References Cited

U.S. PATENT DOCUMENTS

| | | | |
|---|---|---|---|
| 2,002,077 | 5/1935 | Darling et al. | 273/157 R |
| 2,547,948 | 4/1951 | Kornei | 162/138 |
| 2,875,045 | 2/1959 | Lurie | 162/160 |
| 3,608,906 | 9/1971 | Odier | 273/157 R |
| 3,865,382 | 2/1975 | Myller | 273/157 R |

FOREIGN PATENT DOCUMENTS

| | | | |
|---|---|---|---|
| 679163 | 2/1964 | Canada | 273/239 |

*Primary Examiner*—Anton O. Oechsle

*Attorney, Agent, or Firm*—Howard I. Podell

[57] ABSTRACT

A magnetic jigsaw puzzle wherein either the playing board or the play pieces are magnetized and the other is metallic. The method of making magnetized pieces or board comprises mixing iron filings, shredded paper and water with a rust inhibitor in the form of a zinc salt to form a slurry, rolling the slurry, drying the wet mass; printing on the dried sheet; die cutting and packaging.

2 Claims, 6 Drawing Figures

MAGNETIC JIGSAW PUZZLE

FIELD OF THE INVENTION

This invention relates generally to a magnetic jigsaw puzzle for use by handicapped persons or travellers.

DESCRIPTION OF THE PRIOR ART

The prior art, as exemplified by U.S. Pat. Nos. 2,002,077; 2,592,078; 3,432,961; 3,851,884; 3,618,955; 3,608,906; 3,993,313; 1,074,533; 1,549,197; 3,033,573; and 3,181,869 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the methods, processes, instrumentalities and combinations particularly pointed out in the appended claims.

SUMMARY OF THE INVENTION

This invention resides in a magnetic jigsaw puzzle wherein either the playing board or the play pieces are magnetized and the other is metallic. The method of making magnetized pieces or board comprises mixing iron filings, shredded paper, rust inhibitor and water to form a slurry, rolling the slurry, drying the wet mass, printing on the dried sheet; die cutting and packaging.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
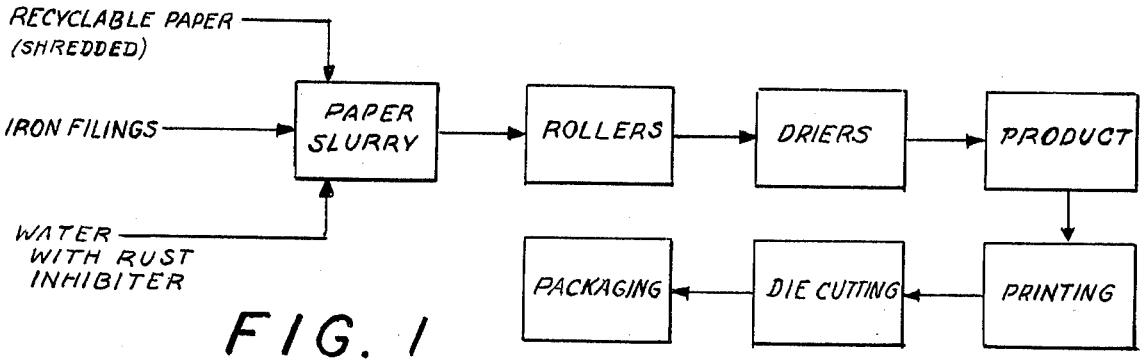
FIG. 1 is a flow diagram showing the steps in making the puzzle of the invention.
Figure 2:
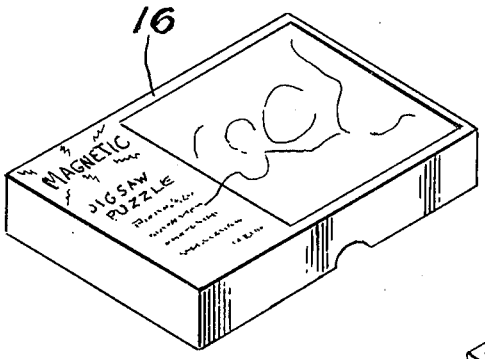
FIG. 2 is a perspective view showing the puzzle in a package.
Figure 3:
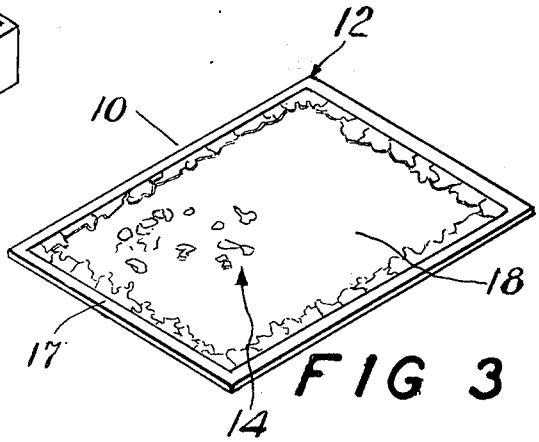
FIG. 3 is a perspective view of the play board.

With reference to the drawing, there is shown and illustrated a magnetic jigsaw puzzle constructed in accordance with the principles of the invention and designated generally by reference character 10. The illustrated tangible embodiment of the invention includes a board 12 with frame 17 and a plurality of play pieces 14 which interfit to form a design constituting the solution to the puzzle.

Both the board 12 and the pieces can be made by the steps shown in FIG. 1. In the practice of the method shown, shredded, preferably recycled paper and a small proportion thereof such as one to ten percent by weight of magnetic iron filings 13 such as waste "swarf" from grinding or milling operations are mixed in a quantity of water sufficient to form a wet slurry. A conventional rust inhibitor such as zinc dithiophosphate is also added to the slurry. The slurry is then processed through conventional paper making machinery to form a sheet of the desired thickness.

Where play pieces are to be made this way, the sheet is then imprinted with the puzzle design and randomly cut into play pieces which are packaged in a display box 16 together with a play board having a metallic playing surface 18.

Figure 6:
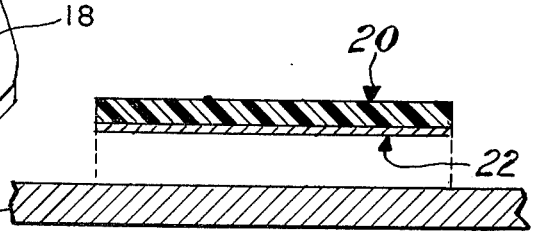
FIG. 6 is a sectional view of a non-magnetic board and magnetic piece.
Figure 5:
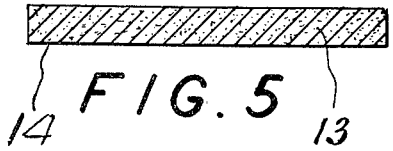
FIG. 5 is a cross-sectional view taken along line V—V of FIG. 4.

FIG. 6 shows another version of the invention wherein each play piece 20 is cut from plastic and has sprayed on its bottom a magnetic layer 22.

Figure 4:
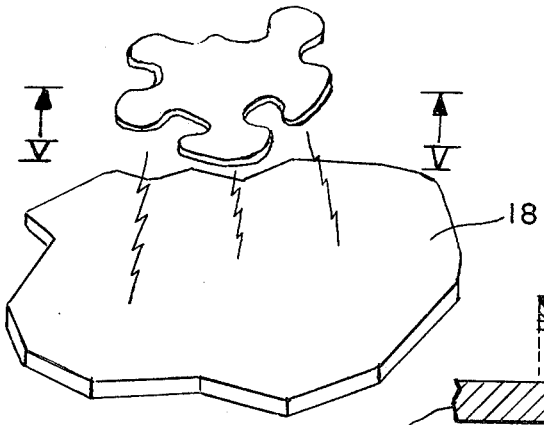
FIG. 4 is a partial view showing operation of the invention.

In FIG. 4 is shown another embodiment wherein board 18 is magnetized and piece 26 is cut from metal.

The puzzle of this invention eliminates clutter and can be played in other than prone position which is helpful for bed-ridden persons. The finished puzzle can be displayed on a wall as a picture without using glue and the picture can be changed as often as desired.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A jigsaw puzzle comprising a board having a playing surface and a set of a plurality of interfitting play pieces, with one of the two of said board and said set of pieces each being of magnetized material and with the other being formed of a metallic material that detachably adheres to a magnetized material, in which the magnetized material is formed of a sheet material comprised of a dried water slurry of mixed shredded paper, and magnetic particles which slurry has been rolled into a sheet and with the magnetic particles being formed of magnetic iron filings, in which a rust inhibitor in the form of a zinc salt has been added to the slurry.

2. The combination as recited in claim 1 in which the rust inhibitor is zinc dithiophosphate.

* * * * *